United States Patent [19]

Jellissen

[11] 4,124,936

[45] Nov. 14, 1978

[54] HALL EFFECT IGNITION SYSTEM HOUSING AND METHOD

[75] Inventor: Roy H. Jellissen, River Grove, Ill.

[73] Assignee: Motorola, Inc., Schaumburg, Ill.

[21] Appl. No.: 790,788

[22] Filed: Apr. 25, 1977

[51] Int. Cl.[2] ..... F02P 3/00

[52] U.S. Cl. ..... 29/602 R; 123/146.5 A

[58] Field of Search ..... 29/602 R, 744, 760; 123/148 R, 148 E, 146.5 A; 200/19 R, 19 M; 310/70 R, 70 A

[56] References Cited

U.S. PATENT DOCUMENTS

| | | | |
|---|---|---|---|
| 4,008,701 | 2/1977 | Webber | 123/148 E |
| 4,011,476 | 3/1977 | Beard | 123/148 R X |

*Primary Examiner*—Carlton R. Croyle
*Assistant Examiner*—Michael Koczo, Jr.
*Attorney, Agent, or Firm*—Phillip H. Melamed; James W. Gillman; Patrick King

[57] ABSTRACT

A housing contains a circuit board having a Hall effect sensor attached thereupon and a magnetic circuit positioned to provide magnetic flux through the Hall effect sensor. The magnetic flux through the Hall effect sensor is interruptable by a high permeability vane moving through an air gap in the magnetic circuit, activating the Hall effect sensor to provide timing signals for an automotive ignition distributor system. The housing contains a flux concentrator and a magnetic and pole piece assembly on opposite sides of the circuit board. Adhesive means fix the magnetic circuit elements and the circuit board in position.

A method for assembling the magnetic circuit elements and the circuit board within the housing described above includes resiliently holding the circuit board in the reference position in the housing. The flux concentrator is inserted within the housing and a gapping gauge having magnetizable portions is attached to the magnet and pole piece assembly, the combination is then inserted into the housing on the opposite side of the circuit board so that the flux concentrator is drawn towards the circuit board and the magnet and pole piece assembly. The magnet and pole piece assembly, the concentrator, and the circuit board are then adhesively fixed to the housing and the gapping gauge is removed to provide a predetermined air gap between the circuit board and the magnet and pole piece assembly, allowing passage of the moving vane within a precisely dimensioned air gap.

3 Claims, 4 Drawing Figures

HALL EFFECT IGNITION SYSTEM HOUSING AND METHOD

BACKGROUND OF THE INVENTION

1. Field of the Invention

This invention generally relates to housings and methods of assembling automotive ignition distributor system components. More particularly, this invention relates to a housing and a method of housing a magnetic circuit and a circuit board for an automotive ignition distributor system having a Hall effect sensor.

2. Description of the Prior Art

Hall effect devices provide an output voltage proportional to the magnetic flux passing therethrough. In order to maximize the output voltage of such a device, it is desirable, therefore, to maintain the flux density through such a device as great as possible. This may be accomplished by keeping the reluctance of the magnetic circuit providing the magnetic flux for the Hall device as small as possible. Since the reluctance of a magnetic circuit is directly proportional to the length of an air gap in the magnetic circuit, it is desirable to control the air gap length as precisely as possible.

Hall effect sensors used in automotive ignition distributor systems provide timing signals for said automotive systems. A distributor shaft coupled to the engine has attached thereto a rotor member having a plurality of peripheral vane members extending therefrom. The vanes may be made of a high permeability ferrous material and alternately pass through an air gap in the magnetic circuit containing a Hall device positioned within the air gap. The flux which passes through the Hall device is shunted away from the Hall device by the vanes. Since it is desirable to maintain the reluctance of the air gap as small as possible, it is desirable that the dimensional variations of the air gap be as small as possible, requiring either precision alignment of or tight tolerances for all the components forming a Hall effect sensor circuit.

Some prior art Hall effect sensor assemblies for use in automotive ignition distributor systems, are contained in molded plastic holders. An air gap is provided for the passage of the vane through the holder and on each side of the air gap are molded portions for containing a magnetic and pole piece assembly and a circuit board assembly containing a Hall effect device and a flux concentrator. Appropriate recesses and slots are molded in the prior art holders for containing the aforementioned components. Since a molded holder has dimensions which will vary within certain tolerance limits, the relative positions of the circuit board, the concentrator, and the magnet and pole piece assembly with respect to each other are subject to variations. It is ultimately desired that the vanes moving through the air gap in the magnetic circuits pass through a gap which is as small as possible. However, it is not possible to provide an air gap of minimum dimensions due to expected tolerance variations of the various component parts and of holder dimensions. The air gap, therefore, sometimes must be made wider than necessary to allow for passage of the vanes.

In addition to the requirement for having an air gap wider than necessary because of dimensional variations in the holder dimensions and the components of a Hall effect sensor assembly, dimensional tolerances between the circuit board containing the Hall effect sensor and the flux concentrator also are present. The dimensional variations in the location of the Hall effect sensor holder with respect to the distributor shaft axis must also be accounted for.

The method for assembling prior art components in a housing involves placing the components within predetermined molded recesses within the housing and fixing said components in place, which because of variation in the housing and component tolerances does not provide a precisely controlled air gap.

Since the circuit board is contained within the housing, which is generally formed from a non-conductive material, heat producing circuit components may not be utilized in such assemblies. For example, integral zener diode regulator circuits, which are particularly useful in automotive applications, are not easily housed in a molded plastic housing assembly.

SUMMARY OF THE INVENTION

Accordingly, an object of this invention is to provide an improved housing and a method for assembling within said housing a Hall effect sensor circuit for an automotive ignition distributor system including a magnetic circuit and a circuit board.

Another object of this invention is to provide a housing for precisely locating a circuit board containing a Hall effect sensor with respect to a distributor shaft axis having a vane rotating thereabout.

Another object of this invention is to provide a means for adjustably receiving the components of a magnetic circuit for a Hall effect sensor device and means for fixedly locating said magnetic circuit components with respect to a predeterminedly fixed circuit board containing a Hall effect sensor element to provide a precisely dimensioned air gap for passage of a moving vane therebetween.

Another object of this invention is to provide a method for assembling a magnetic circuit and a circuit board containing a Hall effect sensor within a housing so that a precise air gap is obtained between the magnetic circuit components.

Another object of this invention is to provide a method for assembling a magnetic circuit and a circuit board containing a Hall effect sensor so that the circuit board is resiliently fixed in a predetermined location and the magnetic circuit components form a precise air gap.

Another object of this invention is to provide a method of assembling a magnetic circuit and a circuit board containing a Hall effect sensor thereon so that dimensional tolerances may be accommodated to provide a precision air gap.

Briefly, the invention comprises a housing in an automotive ignition distributor system which is mounted on a swing arm pivotal about the axis of a distributor shaft. The housing contains a magnetic circuit and a circuit board having a Hall effect sensor affixed thereto. The magnetic circuit has an air gap therein and is interruptable by a high permeability vane moving through said air gap. A base is provided which has means attached thereto for positioning the circuit board in a reference location with respect to said base. Respective means are also provided for adjustably receiving a first and a second portion of said magnetic circuit. Respective means are also provided for fixedly locating the first and the second portion of said magnetic circuit with respect to said circuit board. A predetermined air gap is thereby formed between said circuit board and said second magnetic circuit portion. The base is located with respect to the distributor shaft axis by locating means fixed to said base, said locating means predeterminedly located with respect to the circuit board reference location. The housing may be formed from heat conductive material such that heat sinking is provided for a portion of the circuit board containing heat producing components. The reference location for the circuit board includes reference surfaces which cooperate with corresponding surfaces of the circuit board and which may be mutually perpendicular. The respective means for adjustably receiving portions of the magnetic circuit include upstanding portions having recesses contained therein for adjustably receiving said respective circuit portions. The respective portions of the magnetic circuit may be fixedly located by adhesive means. The means for locating the base on the swing includes raised portions, such as bosses, which are dimensioned to match respective vane portions on said swing arm.

A method for assembling a magnetic circuit in a circuit board in an automotive ignition distributor system housing of the type described above is disclosed. The method includes inserting said circuit board in said housing and holding the circuit board in a reference position in said housing. A flux concentrator is inserted into a receiving portion located on one side of said circuit board. A gapping gauge having a magnetizable portion is attached to a magnet and pole piece assembly, and the combination is inserted into another receiving portion of said housing on the opposite side of said circuit board so that the circuit board is positioned between the gapping gauge and the flux concentrator. The flux concentrator is drawn toward the circuit board and the magnet and pole piece assembly and the combination is held in position thereby. The magnet and pole piece assembly, the concentrator, and the circuit board are fixed to the housing by fixing means, including adhesive means. The gapping gauge is removed and a predetermined air gap is provided between the circuit board and the magnet and pole piece assembly for passage of the moving vane of said distributor system. The circuit board may be resiliently positioned in place in the reference location by spring means.

BRIEF DESCRIPTION OF THE DRAWINGS

For a more complete understanding of the invention, reference is made to the drawings, in which.

DESCRIPTION OF THE PREFERRED EMBODIMENT

Figure 1:
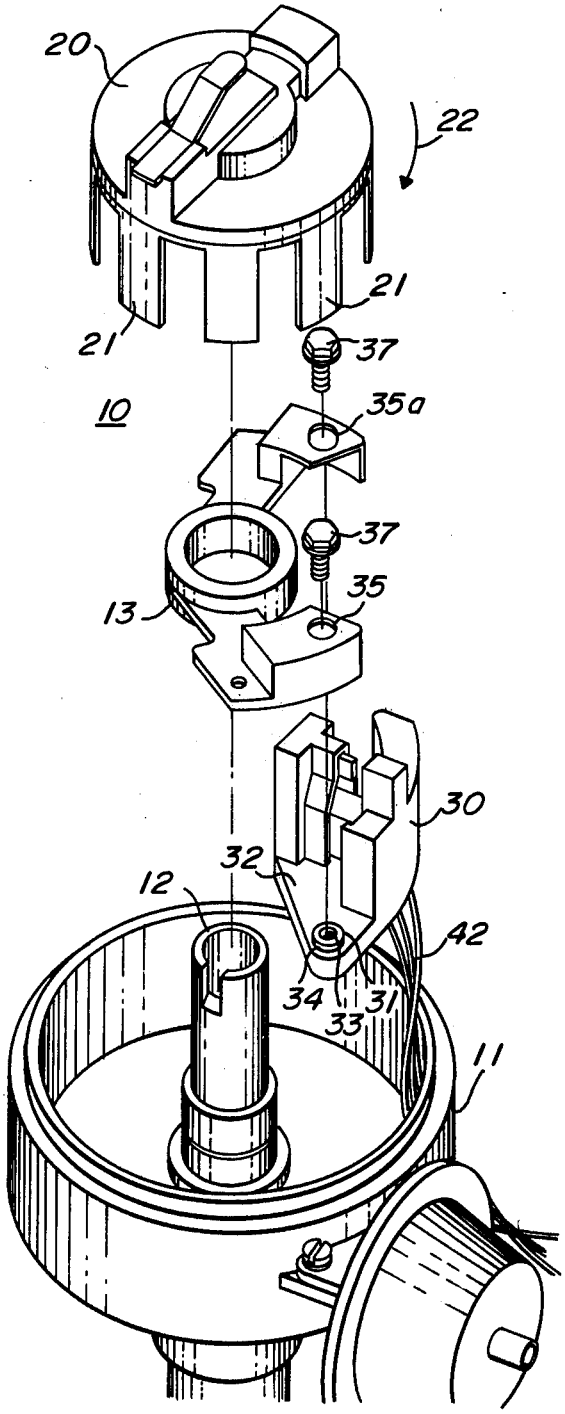
FIG. 1 is a perspective view of an automotive ignition distributor system having a housing containing a magnetic circuit and a circuit board having a Hall effect sensor mounted thereon according to the invention.

Referring to FIG. 1 of the drawings, an automotive ignition distributor system assembly 10 is shown having a distributor base assembly 11. Contained within the distributor base assembly 11 is a distributor shaft 12 which is rotatable about an axis in synchronism with various other mechanical components of an automotive engine, as is well known in the art. A swing arm 13 is pivotally mounted about the distributor shaft 12 and provides for advancement or retardation of the timing signals of said ignition system.

Mounted on an end of the distributor shaft 12 is a rotor assembly 20 which has peripherally mounted and downwardly extending vanes 21. The vanes 21 are curved, ferrous plates of rather thin dimensions having a high permeability which serve to provide a shunt path for magnetic flux, as will be described hereinbelow. The rotor assembly 20 rotates about the axis of distributor shaft 12 in a reference direction 22 for motion of the vanes 21.

A housing 30 is mounted on the swing arm 13. Two raised portions, or bosses, 31 are contained on a base portion 32 of said housing 30. Each boss 31 has a threaded central bore 33 contained therein. The cylindrical exterior surfaces 34 of each boss 31 are dimensioned to match respective mating cavities 35 on the swing arm 13 so as to provide accurate positioning of the housing 30 with respect to the axis of the distributor shaft 12. Since the rotor assembly 20 is also mounted on the distributor shaft this permits the vanes 21 to be accurately aligned with respect to the housing 30. The housing 30 is attached to the swing arm 13 by having the bosses 31 positioned within the cavities 35. The housing is fixed in position and locked in place by screws 37 engaged in the threaded central bores 33 of housing 30. One of the cavities 35a is slightly eccentric to allow for dimensional variations between the location of the cavities 35 on the swing arm 13.

Figure 2:
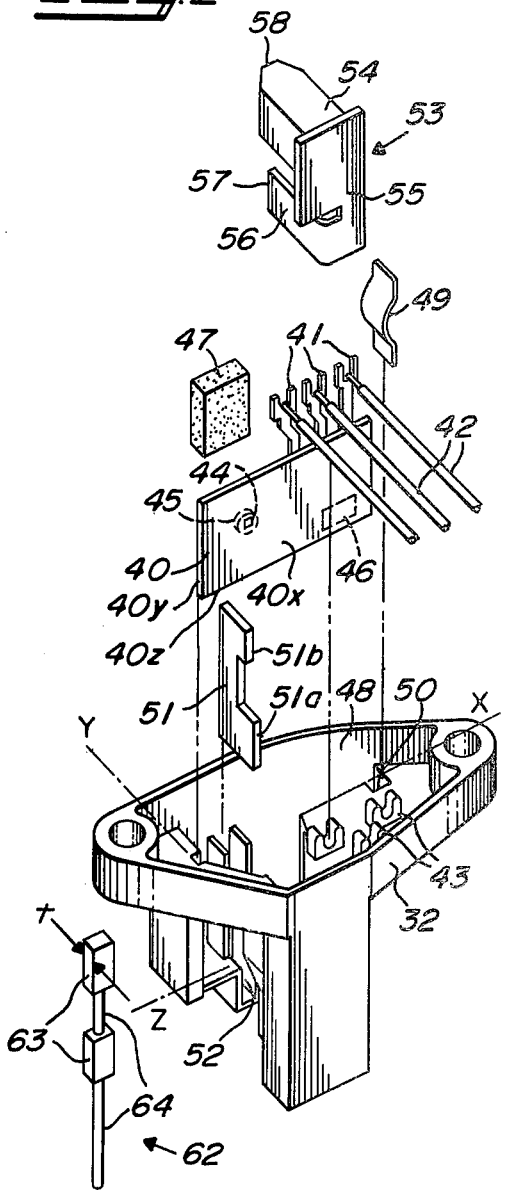
FIG. 2 is an exploded, perspective view of the housing according to the invention as well as of the magnetic circuit elements, the circuit board, resilient means for holding the circuit board in reference position, and a gapping tool.

Referring to FIG. 2, a circuit board 40 is formed for example, from a ceramic material into a rectangular wafer and contains thereupon various conductors and circuit elements, as well as terminals 41 which are soldered to pads on the circuit board 40 and which provide electrical connections from the circuit board to external circuit elements. Wires 42 are soldered to terminal 41 at one end and are held in position by crimp portions 43 contained within the base 32 of the housing 40. The crimp portions 43 provide strain relief for the wires 42 attached to the terminals 41 of the circuit board 40. A Hall effect sensor 44 is mounted beneath a brass cap 45 on the circuit board 40. A printed resistor 46 deposited on the circuit board serves as a ballast resistor for a zener diode and requires heat sinking for the heat produced therein.

The back surface $40_X$ of the circuit board 40 has no components or conductors mounted thereupon and provides a relatively flat, smooth, surface. The back surface $40_X$ mounts flush against a reference surface X of the housing 30. The housing 30 may be formed from a zinc diecast alloy which provides good heat sinking properties. Mutually perpendicular reference surfaces X, Y, and Z are precisely formed in the housing 30 with respect to the location of the bosses 31. A bottom surface $40_Y$ of the circuit board and a side surface $40_Z$ of the circuit board 40 in conjunction respectively with reference surfaces Y and Z of the housing 30 provide for precise positioning of the circuit board 40 with respect to the housing 30. Since the reference surfaces X, Y, and Z are precisely positioned with respect to the bosses 31, it follows that the circuit board 40 is precisely positioned with respect to the bosses 31 and, consequently, with respect to the axis of distributor shaft 12. The positioning of the circuit board 40 with respect to the vane 21 is therefore precisely controlled. After the circuit board 40 is positioned with respect to reference surfaces X, Y, and Z of the housing 30, the circuit board 40 is resiliently held in that position by resilient material such as, for example, a piece of sponge rubber 47 which is wedged between the component side of the circuit board 40 and the housing inner wall surface 48. Similarly, the circuit board side surface $40_Y$ is resiliently retained against the housing reference surface Y by a spring clip 49 which is held in a cavity 50 formed in the housing for retaining the spring clip 49. The circuit board bottom surface $40_Z$ is retained against the housing reference surface Z also. Printed resistor 46 is heat sinked through the thin ceramic circuit board 40 to the housing inner wall surface 48 along surface X.

Figure 4:
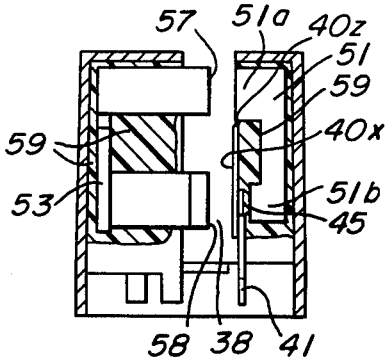
FIG. 4 is a partial sectional view taken along section line 4—4, showing the positioning of the magnetic circuit elements and the circuit board within the housing according to the invention.

Referring to FIG. 4, the back surface $40_X$ of the circuit board 40 is shown positioned against reference surface X of housing 30 and the bottom surface $40_Z$ of the circuit board 40 is shown positioned against the reference surface Z of housing 30.

Referring to both FIG. 2 and to FIG. 4, a flux concentrator is formed from a flat sheet of carbon steel and has two projections each respectively having an elongated upper face 51*a* and an elongated lower face 51*b*.

The flux concentrator 51 is one portion of the magnetic circuit for the Hall effect element and is loosely contained within a recess 52 formed by portions of the housing inner wall surface 48. The recess 52 provides a means for adjustably receiving the flux concentrator 51 which, as will be described hereinbelow, is fixedly located in position by an appropriate adhesive means. After final circuit assembly and testing, the flux concentrator is surrounded by a potting material 59 as shown in FIG. 4.

Figure 3:
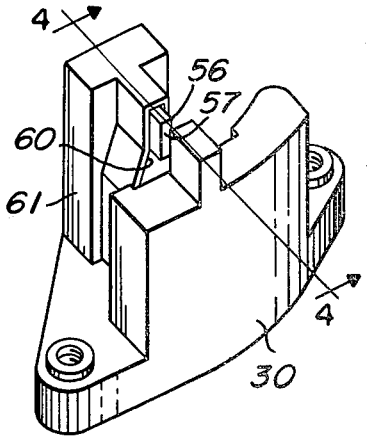
FIG. 3 is a perspective view of the housing containing the magnetic circuit elements on the circuit board assembled into position.

A magnet and pole piece assembly 53 is formed, for example, by soldering an oblong shaped tin plated magnet 54 to a pole piece 55, said pole piece formed from a flat carbon steel plate and having an arm portion 56 extending outwardly. The arm portion 56 has a flat elongated pole face 57 at the end thereof and the magnet 54 has a flat elongated pole face 58 at the end thereof. As shown in FIG. 3, the magnet and pole piece assembly 53 is adjustably contained within a recessed portion 60, which is located opposite recess 52 along the housing inner wall surface 48. The recessed portion 60 is contained within an upstanding portion 61 of the housing 30. The magnet and pole piece assembly 53 is also fixedly located in recessed portion 60 of the upstanding portion of 61 of the housing 30 by an appropriate adhesive means. FIG. 4 shows a magnet and pole piece assembly 53 assembled within the housing that is surrounded by potting material 59 which is added after final assembly and electrical testing.

The method of assembling the magnetic circuit including the flux concentrator 51 and the magnet and pole piece assembly 53, and the circuit board 40 into the housing 30 includes positioning and holding the circuit board 40 in place against the reference surfaces X, Y and Z of the housing 30 as described hereinabove using the removable sponge rubber piece 47 and the spring clip 49. The flux concentrator 51 is then inserted into the recess 52, which loosely holds the concentrator 51 in position on one side of the circuit board 40. A gapping gauge 62 as shown in FIG. 2 is formed having two ferrous portions 63, which are spaced apart by the same distance as between the pole faces of the magnet and pole piece assembly 53 and which are separated by a non-magnetic portion 64. The ferrous portions 63 of the gapping gauge 62 both have a thickness dimension *t* which determines the width of the air gap 38. The gapping gauge 62 is attached to the magnet and pole piece assembly by magnetic attraction. The combination of the gapping gauge and the magnet and pole piece assembly is then inserted on the opposite side of the circuit board 40 so that the gauging ferrous portions 63 are positioned respectively between the arm pole face 57 and the upper flux concentrator face 51*a* and the magnet pole face 58 and the flux concentrator lower face 51*b*. Due to magnetic attraction between the various magnetic components, the flux concentrator upper face 51*a* is drawn against the brass cap 45 surrounding the Hall effect sensor 44 and is in contact with said brass cap. Since the magnet and pole piece assembly 53 and the flux concentrator 51 are adjustably received, or float, within the housing 30, the dimensional variations of the components and the housing are compensated for when the air gap is precisely set with respect to the circuit board by means of the gapping gauge 62. Therefore, the tolerances which must be held on the dimensions of the various components and the housing of this invention are not critical because the air gap is set precisely with respect to the circuit board 40, which is precisely positioned with respect to the rotor assembly vanes 21.

The magnet and pole piece assembly 53, the circuit board 40, and the flux concentrator 51 are then fixed in position within the housing by a suitable adhesive means. The gapping gauge is then removed to provide a predetermined air gap as described above. The sponge rubber piece 47 is then removed. After final inspection and electrical testing, the magnetic circuit is potted into place by a suitable potting material 59.

While a particular embodiment of the present invention as been shown and described it should be understood that the invention is not limited thereto since many modifications may be made. It is therefore, contemplated to cover by the present application any and all such modifications fall within the true spirit and scope of the basic underlined principles disclosed and claimed herein.

I claim:

1. A method for assembling a magnetic circuit and a circuit board in an automotive ignition distributor system having a swing arm, said circuit interruptable by a high permeability vane moving through an air gap in said magnetic circuit, said circuit board having a Hall effect sensor attached thereto, said method comprising the steps of:

inserting the circuit board in a housing;

holding the circuit board in a reference position in the housing;

inserting a flux concentrator into a receiving portion of said housing on one side of said circuit board;

attaching a gapping gauge having magnetizable portions to a magnet and pole piece assembly;

inserting said gapping gauge and said magnet pole piece assembly into another receiving portion of said housing on the opposite side of said circuit board so that the circuit board is positioned between said gapping gauge and said flux concentrator with flux passing through the Hall effect sensor located on said circuit board, said flux drawing the flux concentrator toward the circuit board and the magnet and pole piece assembly;

fixing the magnet and pole piece assembly, the concentrator, and the circuit board to the housing; and removing the gapping gauge to provide a predetermined air gap between the circuit board and the magnet and pole piece assembly for passage of the moving vane.

2. The method of claim 1 wherein holding the circuit board in position the housing includes resiliently positioning portions of the circuit board against reference locations in said housing the spring means.

3. The method of claim 1 wherein fixing the magnet and pole piece assembly, the concentrator, and the circuit board to the housing includes applying an adhesive means between said elements and the housing.

* * * * *